US006675506B2

(12) United States Patent
Pitts

(10) Patent No.: US 6,675,506 B2
(45) Date of Patent: Jan. 13, 2004

(54) MOTORIZED ICE BREAKING APPARATUS

(76) Inventor: Alfred Y. Pitts, 615 49th St., Washington, DC (US) 20019

( * ) Notice: Subject to any disclaimer, the term of this patent is extended or adjusted under 35 U.S.C. 154(b) by 65 days.

(21) Appl. No.: 09/989,371

(22) Filed: Nov. 21, 2001

(65) Prior Publication Data

US 2002/0083626 A1 Jul. 4, 2002

Related U.S. Application Data

(60) Provisional application No. 60/259,073, filed on Jan. 2, 2001.

(51) Int. Cl.[7] ..... E01H 5/08
(52) U.S. Cl. ..... 37/221; 37/241
(58) Field of Search ..... 37/241, 242, 243, 37/219, 221, 222, 223

(56) References Cited

U.S. PATENT DOCUMENTS

| | | | | | |
|---|---|---|---|---|---|
| 1,205,342 | A | * | 11/1916 | Glass | 172/116 |
| 1,228,992 | A | * | 6/1917 | Ullman | 172/43 |
| 2,871,957 | A | * | 2/1959 | Zacharias, Jr. | 172/42 |
| 2,871,958 | A | * | 2/1959 | Zacharias, Jr. | 172/42 |
| 2,983,057 | A | * | 5/1961 | Erickson | 37/243 |
| 3,024,545 | A | * | 3/1962 | Clark et al. | 37/243 |
| 3,117,633 | A | * | 1/1964 | Hosek | 172/42 |
| 3,539,014 | A | * | 11/1970 | Joneson | 172/111 |
| 3,724,182 | A | * | 4/1973 | Long et al. | 56/10.4 |
| 3,775,878 | A | * | 12/1973 | Beckner | 37/233 |
| 3,779,319 | A | * | 12/1973 | Pease | 172/45 |
| 4,053,958 | A | * | 10/1977 | Taylor | 15/93.1 |
| 4,096,915 | A | * | 6/1978 | Groth | 172/42 |
| 4,186,967 | A | * | 2/1980 | Kuhmonen | 299/25 |
| 4,278,133 | A | * | 7/1981 | de Marcellus | 172/14 |
| 4,282,666 | A | * | 8/1981 | Brandt | 37/197 |
| 4,619,061 | A | * | 10/1986 | Swanson | 37/248 |
| 4,719,743 | A | * | 1/1988 | Bokon | 56/294 |
| 4,811,794 | A | * | 3/1989 | Greene | 172/43 |
| 4,892,154 | A | * | 1/1990 | Ranner | 172/72 |
| 4,921,051 | A | * | 5/1990 | Annen | 172/21 |
| 5,040,315 | A | * | 8/1991 | Matson | 37/223 |
| 5,067,263 | A | * | 11/1991 | Pelletier | 37/220 |
| 5,106,165 | A | * | 4/1992 | Lattman | 299/25 |
| 5,357,698 | A | * | 10/1994 | Phillips | 37/243 |
| 5,540,004 | A | * | 7/1996 | Patterson et al. | 37/244 |
| 5,970,574 | A | * | 10/1999 | Thrash, Jr. | 15/321 |

* cited by examiner

*Primary Examiner*—Thomas B. Will
*Assistant Examiner*—Kristine Florio
(74) *Attorney, Agent, or Firm*—Nath & Associates PLLC; Marvin C. Berkowitz

(57) ABSTRACT

A motorized ice breaking apparatus has a housing with a power source connected thereto. A drive train is operatively connected to the power source. The drive train includes a drive shaft with a crank. A blade is disposed on a bottom side of the housing and extends laterally from a first side to a second side of the housing. A connecting rod is pivotally connected to the blade and pivotally connected to the drive shaft's crank. A pair of guide channels is connected to the bottom of the housing, one guide channel being proximate each lateral side. Ends of the blade are slidingly engaged in corresponding ones of the guide channels. The power source rotates the drive shaft and imparts a reciprocating motion to the connecting rod through the crank. The reciprocating motion of the connecting rod reciprocates the blade in a substantially vertical motion.

23 Claims, 4 Drawing Sheets

MOTORIZED ICE BREAKING APPARATUS

This application is a nonprovisional of U.S. provisional application No. 60/259,073 filed Jan. 2, 2001.

FIELD OF THE INVENTION

The present invention is directed to a motorized ice breaking and removal apparatus for breaking and removing ice that has formed on a ground surface such as a paved sidewalk, driveways, platforms, brick, marble, and other concrete surfaces.

During cold weather precipitation in the form of sleet, or freezing rain often times results in thick layers of ice on ground surfaces, including paved surfaces, such as pedestrian walking areas. Similarly hard packed snow can likewise results in ice-like accumulations on ground surfaces causing dangerous and extreme walking conditions. As snow accumulations melt during daytime sunlight, the melt will frequently re-freeze during cooler overnight hours thereby creating further ice conditions and ice layer accumulations.

While snow can oftentimes be selectively removed by shoveling, plowing or by the use of snow blowers, accumulated ice along ground surfaces oftentimes remains. These ice conditions on ground surfaces, particularly ground surfaces where people must walk or drive, are notoriously hazardous and frequently result in serious personal injuries, including death.

BACKGROUND OF THE PRIOR ART

Prior art techniques for ice removal include use of chemical deicing agents, hand-powered scrapers and chisels, and various power apparatus.

U.S. Pat. No. 5,353,881 to Lee et al. discloses a utility machine having counter rotating horizontal shafts to which various accessories, including ice breaking attachments, can be attached.

U.S. Pat. No. 5,040,315 to Matson discloses an ice scarifying tool that replaces a conventional rotary lawn mower blade so that when operated over an icy surface the tool rotates in a plane substantially parallel to the ground surface. Depending fingers attached to the tool scarify the ice as the blade rotates. Depth of scarifying is inherent in the wheel adjustments of the lawnmower to which the tool is attached.

U.S. Pat. No. 4,278,133 to de Marcellus discloses an ice chipper attachment to a lawn edger which rotates about a horizontal axis.

U.S. Pat. No. 4,186,967 to Kuhmonen discloses an ice chopping apparatus having a number of horizontal aligned rotary disks with depending chippers which strike and pulverize ice on a horizontal paved surface.

U.S. Pat. No. 4,096,915 to Groth discloses a multipurpose machine having a horizontal shaft to which a plural number of arms are pivotally connected. Each arm can be equipped with an ice chopping blade which is caused to reciprocate in a substantially vertical plane as a consequence of rotation of the horizontal shaft.

U.S. Pat. No. 4,053,958 to Taylor discloses a tool holder carrying an ice scraping blade that is caused to oscillate about a vertical axis in response to eccentric rotation of a flywheel.

U.S. Pat. No. Re. 29,356 to Bennett discloses an ice chopping apparatus having counter rotating drums which rotate about a vertical axis. Each drum is equipped with ice chopping teeth along the circumference of its bottom surface. A helical auger removes the ice chips as the drums rotate.

U.S. Pat. No. 3,621,920 to Brown discloses a multipurpose aerating apparatus having a plural number of vertically reciprocating spikes that can be used to break ice on a paved surface.

U.S. Pat. No. 3,724,182 to Long, et al. discloses an ice scarifying tool that replaces a conventional rotary lawn mower blade so that when operated over an icy surface the tool rotates in a plane substantially parallel to the ground surface. Depending fingers attached to the tool scarify the ice as the blade rotates.

U.S. Pat. No. 3,340,626 to Konucik discloses an attachment to a lawnmower having a geartrain driven from the engine crankshaft. Connected to the geartrain is a drive shaft which is further connected by gears, belts and pulleys to a shaft having snow and ice cutting teeth arranged radially along the length of the shaft. The shaft rotates causing the teeth to cut the snow and ice.

Each of the above cited U.S. patents is hereby incorporated herein by reference.

SUMMARY OF THE INVENTION

It is an object of the present invention to provide an a motorized ice breaking apparatus comprising a housing having a top, a bottom, a first lateral side and a second lateral side with a power source connected to the housing wherein a drive train is operatively connected to the power source, the drive train including a drive shaft having a first end and a second end; at least one blade having a first end and a second end disposed on the bottom side of the housing, whereby the at least one blade extends laterally from the first lateral side of the housing to the second lateral side of the housing; at least one connecting rod having a leading end and a following end, the following end connected to the at least one blade; at least one crank connected to the drive shaft, the at least one crank pivotally connected to the leading end of the at least one connecting rod; a first guide channel connected to the bottom of the housing proximate to the first lateral side thereof, the first end of the at least one blade being slidingly engaged in the first guide channel; and a second guide channel connected to the bottom of the housing proximate to the second lateral side thereof, the second end of the at least one blade being slidingly engaged in the second guide channel.

It is a further object of the present invention to provide a motorized ice breaking apparatus having two blades, a first relatively sharp blade for chopping ice and a second blunt blade for pulverizing ice.

It is still a further object of the present invention to provide a motorized ice breaking apparatus wherein wheels of the apparatus are operatively connected to the power source.

These and other objectives, advantages, and features of the present invention will be expounded upon and set forth in, or apparent from, the accompanying detailed description of a presently preferred embodiment of the invention.

DETAILED DESCRIPTION

Figure 1:
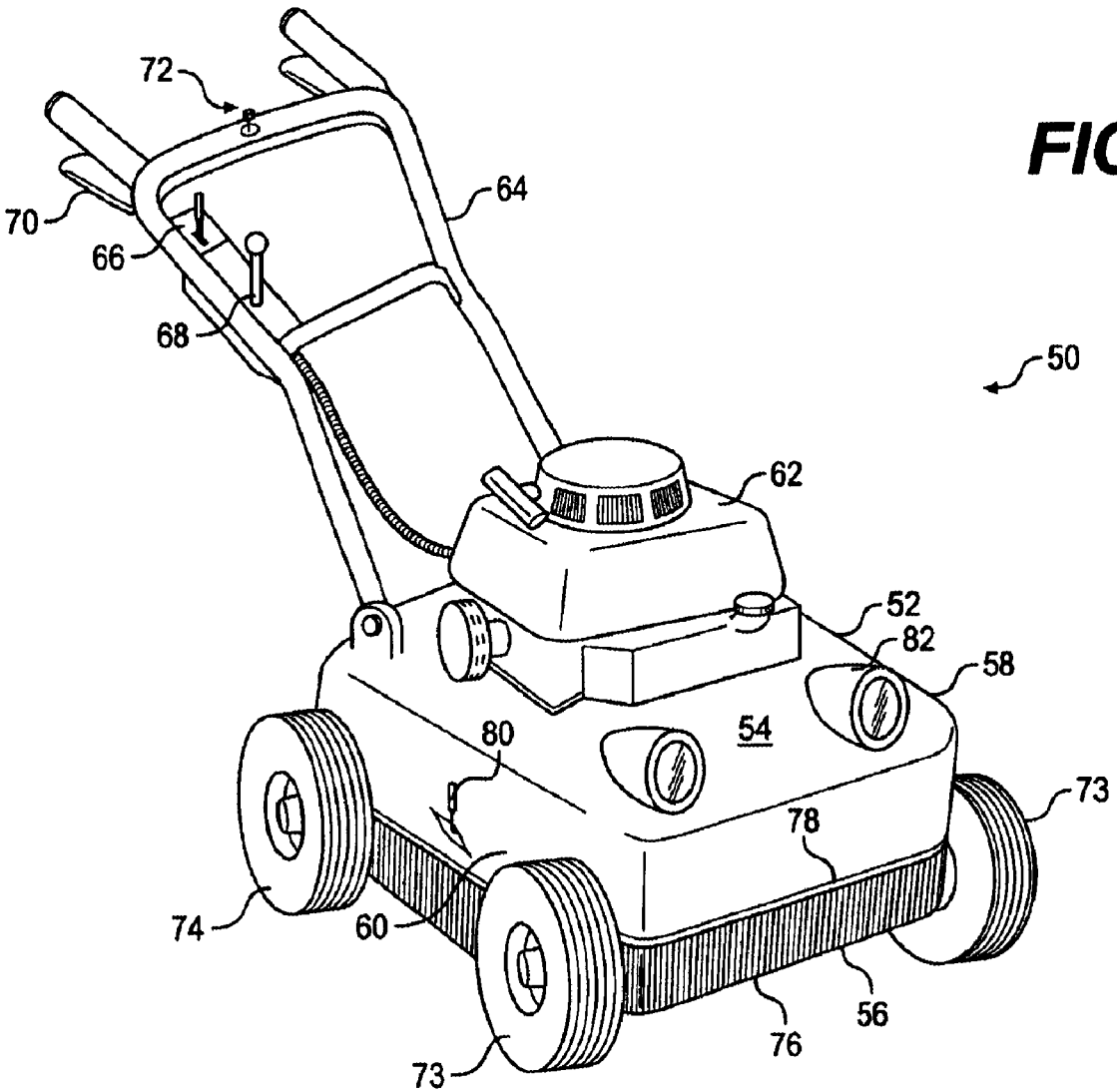
FIG. 1 is a perspective view of a Motorized Ice Breaker of the present invention.

With reference to the figures wherein like numerals represent like elements throughout the several views, there is shown in FIG. 1 an ice breaking apparatus 50 of the present invention.

Ice breaking apparatus 50 comprises generally a housing 52 having a top 54, a bottom 56, a first lateral side 58 and a second lateral side 60. A power source 62 is mounted to top 54 of housing 52. Power source 62 can be any conventional power source such as a vertical output shaft internal combustion engine (as shown); a horizontal output shaft internal combustion engine (not shown); an electric motor (not shown); or other conventional power source.

As shown in FIG. 1, an operator handle 64 is conventionally connected to housing 52. Handle 64 has disposed thereon various operator controls such as a throttle or motor speed control 66, a wheel height adjustment 68, and a clutch release 70. Additionally, handle 64 can include a power on/off control 72.

Housing 52 also carries a pair of wheels 73 and a pair of wheels 74 which are conventionally connected to sides 58 and 60 of housing 52. In an alternate embodiment (not shown), wheels 73 can be housed in a vertically gimbaled pivot head whereby they are pivotable about a vertical axis as they rotate about a horizontal axis. In the preferred embodiment shown, a debris guard 76 is disposed depending from peripheral edge 78 of housing 58. Debris guard 76 can prevent ice chips (not shown) from being propelled or ejected out from under housing 52. Housing 52 also carries a adjuster 80 for adjusting a depth of stroke. Optionally, housing 52 can be provided with lights 82 to facilitate use of apparatus 50 in low light and inclement weather conditions.

Figure 2:
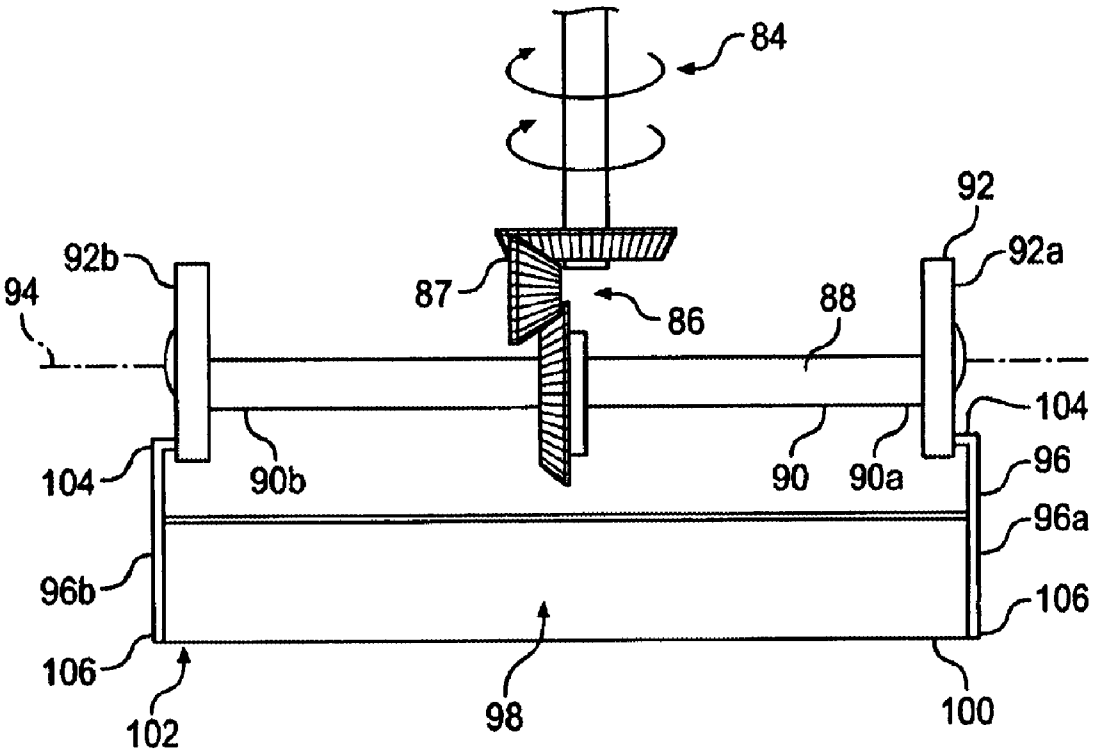
FIG. 2 is a partial elevational view of a drive train for a vertically reciprocating blade of the Motorized Ice breaker.

Referring now to FIG. 2, power source 62 (shown in FIG. 1) has a rotating output shaft 84 which extends through an opening (not shown) communicating through housing 52. A drive train 86 is operatively connected to shaft 84. Drive train 86 includes a set of gears 87 and a drive shaft 88 having at least one end 90 having a crank 92. In an alternative embodiment (not shown) the drive train can comprises a series of belts and pulleys. Rotational motion of power source 62's output shaft 84 is transferred through drive train 86 and gears 87 to drive shaft 88 which rotates about a horizontal axis 94. Crank 92 connected to drive shaft 88 rotates in relation to the rotation of drive shaft 88. Crank 92 is operatively connected by connecting rod 96 to blade 98. In the preferred embodiment of FIG. 2 there are two cranks 92*a* and 92*b* connected at corresponding ends 90a and 90b of drive shaft 88. A first end 100 of blade 98 is connected to crank 92*a* by connecting rod 96*a*; a second end 102 of blade 98 is connected to crank 92*b* by connecting rod 96*b*. Connecting rods 96*a* and 96*b* each have leading ends 104 and following ends 106. Each of leading ends 104 are pivotally connected to corresponding cranks 92*a* and 92*b*; and each of following ends 106 are connected to corresponding ends 100 and 102 of blade 98. Rotational motion about horizontal axis 94 of drive shaft 88 is converted by cranks 92 and connecting rods 96 connected thereto into a linear reciprocating motion which is transmitted to blade 98. In this preferred embodiment cranks 92*a* and 92*b* are axially aligned so that blade 98 connected thereto uniformly reciprocates in a vertical direction. In an alternate embodiment (not shown) cranks 92*a* and 92*b* can be other than axially aligned so that blade 98 connected thereto rocks about a horizontal axis as it vertically reciprocates. A further alternate embodiment (not shown) has a single drive shaft 88 having one crank 92 connected to blade 98 by one connecting rod 96. In this embodiment connecting rod 96 can be connected at one end of blade 98 and the other end of blade 98 can be pivotally connected to housing 52 so that blade 98 reciprocates in a half-scissor-like motion relative to the ground. Alternatively a single connecting rod 96 can be connected to an intermediate part of blade 98 so that the entire blade 98 reciprocates vertically similar to the preferred embodiment having two connecting rods.

In yet a further alternate embodiment (not shown) drive train 86 can include a transmission (not shown) which can be either manually operated or automatic. Drive train 86 can also include a clutch (not shown) for engaging and disengaging drive shaft 88 from output shaft 84 of power source 62 without need for turning power source 62 off.

Figure 3:
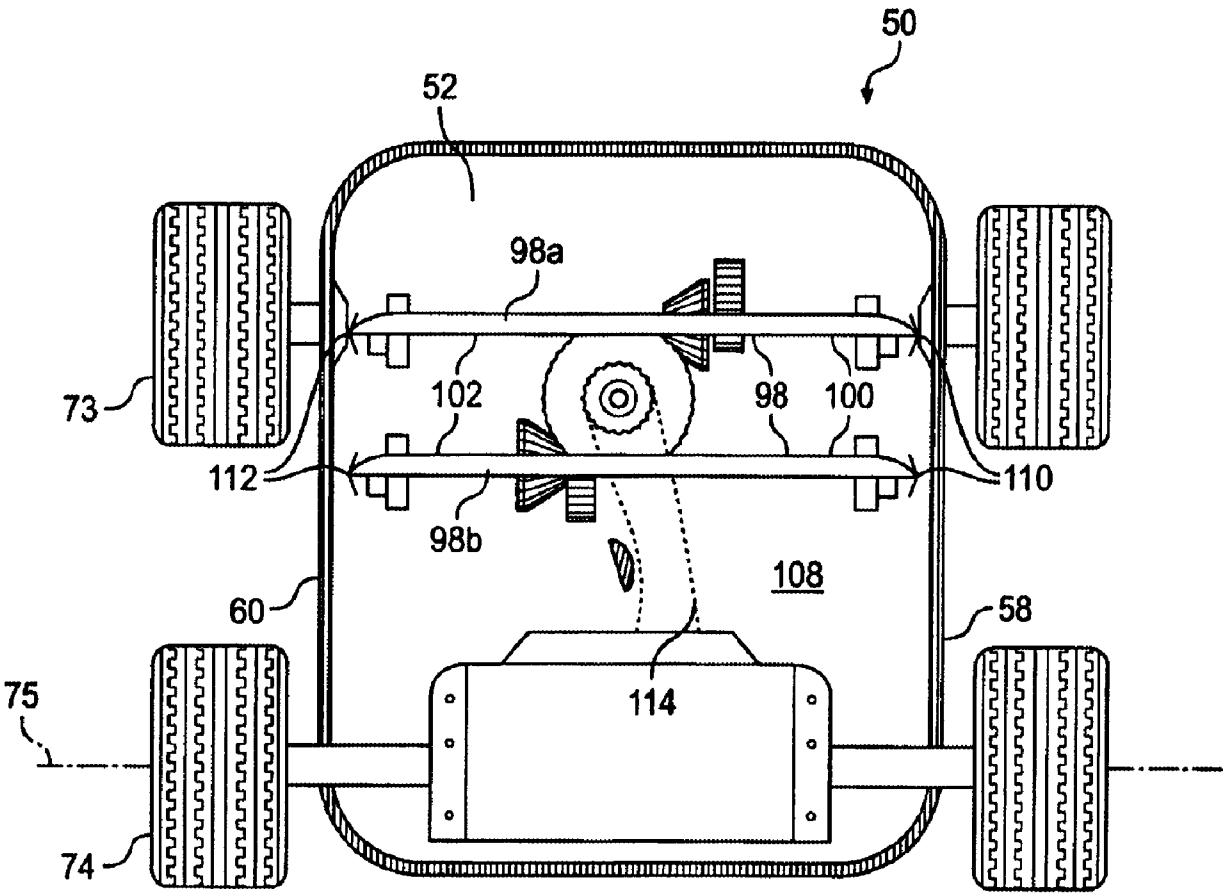
FIG. 3 is a bottom plan view of the embodiment of the Motorized Ice Breaker of FIG. 1.

Referring now to FIG. 3, housing 52 has a bottom 108. Two blades 98 generally mounted in a transverse direction and generally parallel each other extend laterally from first lateral side 58 of housing 52 to second lateral side 60 of housing 52. First guide channels 110 are connected to bottom 108 of housing 52 proximate to first lateral side 58, and corresponding first ends 100 of blades 98 are slidingly engaged therein. Second guide channels 112 are connected to bottom 108 of housing 52 proximate to second lateral side 60, and corresponding second ends 102 of blades 98 are similarly slidingly engaged therein. Guide channels 110 and 112 limit horizontal motion of blades 98.

In the preferred embodiment shown in FIG. 3 blades 98 comprise two blades, a first sharp blade 98*a* for cutting ice, and a second blunt blade 98*b* for crushing ice. In an alternate embodiment (not shown) apparatus 50 can have only one blade 98. Blades 98*a* and 98*b* are operatively coupled to power source 62's output shaft 84 (shown in FIG. 2) by corresponding drive shafts 88 (hidden from view in FIG. 3). Cranks 92 (such as shown in FIG. 2) of each drive shaft 88 are operatively coupled by connecting rods 96 to corresponding ones of blades 98*a* and 98*b*.

Figure 4:
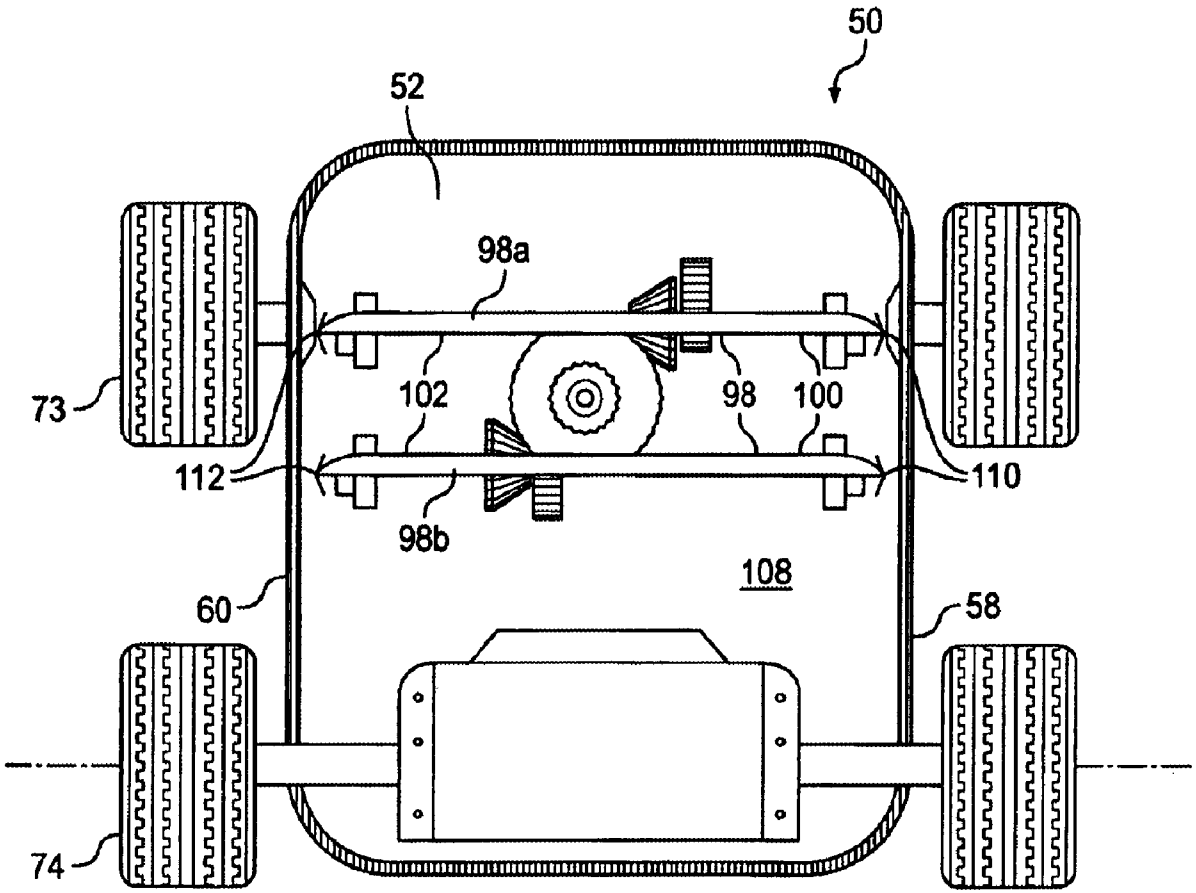
FIG. 4 is a bottom plan view of a second embodiment of the Motorized Ice Breaker of FIG. 1.

In the preferred embodiment of FIG. 3 ice chopping apparatus 50 includes a power drive 114 wherein at least one of wheels 74 can be conventionally operatively coupled to output shaft 84 of power source 62 through drive train 86 so that apparatus 50 can be power propelled. In an alternate embodiment such as shown in FIG. 4, power drive 114 can be omitted. In the preferred embodiment shown in FIG. 3 wheels 74 rotate about horizontal axis 75.

In the preferred first embodiment shown in FIGS. 1–4, power source 62 is mounted to top 54 of housing 52 and drive shaft 88 is mounted to bottom 108 of housing 52. In an alternate embodiment (not shown) power source 62 can be mounted to a side, front, or rear of housing 52 or on bottom 108. In a further alternative embodiment (not shown), such as an embodiment using a horizontal shaft electric motor or horizontal shaft internal combustion engine, drive shaft 88 can be integral with power source 62's output shaft 84. In yet a further alternate embodiment (not shown) drive shaft 88 can be mounted to top 54 or through a side of housing 52.

In a further alternate embodiment, the apparatus can include counter rotating brushes operatively coupled to the power source to sweep the chopped ice debris out of a path in which the apparatus is used.

Although the preferred embodiment of the present invention has been shown and described in detail, it should be understood that various changes and modifications may be made therein without departing from the spirit and scope of the appended claims.

I claim:

1. A power driven ice breaking apparatus comprising:

a housing having a top, a bottom, a first lateral side and a second lateral side;

a power source connected to said housing;

a drive train operatively connected to said power source, said drive train including a drive shaft, said drive shaft having an axis of rotation, a first end and a second end;

at least one blade adapted to reciprocate substantially vertically disposed on said bottom side of said housing, said at least one blade extends laterally from a first end disposed proximate said first lateral side of said housing to a second end disposed proximate said second lateral side of said housing;

at least one connecting rod having a leading end and a following end, said following end connected to said at least one blade;

at least one crank connected to said drive shaft, said at least one crank being pivotally connected to said leading end of said at least one connecting rod;

a first substantially vertical guide channel connected to the bottom of said housing proximate to the first lateral side thereof, said first end of said at least one blade being slidingly engaged in said first guide channel;

a second substantially vertical guide channel connected to the bottom of said housing proximate to the second lateral side thereof, said second end of said at least one blade being slidingly engaged in said second guide channel;

whereby a rotational motion of said drive shaft and said at least one crank about said axis of rotation imparts a substantially vertical reciprocating motion to one of said first and second ends of said at least one blade.

2. The ice breaking apparatus as claimed in claim 1 wherein said at least one crank comprises first and second cranks axially aligned with each other.

3. The ice breaking apparatus as claimed in claim 1 wherein said at least one crank comprises first and second cranks other than axially aligned with each other.

4. The ice breaking apparatus as claimed in claim 1 further comprising an adjustor that adjusts an extent of the substantially vertical reciprocating motion of one end of said at least one blade.

5. The ice breaking apparatus as claimed in claim 1 wherein said power source is an electric motor.

6. The ice breaking apparatus as claimed in claim 1 wherein said power source is an internal combustion engine.

7. The ice breaking apparatus as claimed in claim 1 further comprising:

an operator handle connected to said housing and extending upwardly and rearwardly therefrom.

8. The ice breaking apparatus as claimed in claim 1 further comprising:

a plurality of wheels connected to said housing, at least one of said plurality of wheels rotating about at least one axis of rotation transverse to said housing.

9. The ice breaking apparatus as claimed in claim 8 further comprising a wheel height adjuster.

10. The ice breaking apparatus as claimed in claim 8 wherein at least one of said plurality of wheels is operatively connected to said power source.

11. The ice breaking apparatus as claimed in claim 1 further comprising a clutch interposed between said power source and said drive shaft.

12. The ice breaking apparatus as claimed in claim 1 wherein said at least one blade comprises two blades.

13. The ice breaking apparatus as claimed in claim 12 further comprising a sharp chopping blade and a blunt crushing blade.

14. The ice breaking apparatus as claimed in claim 1 further comprising a debris guard.

15. The ice breaking apparatus as claimed in claim 1 further comprising a clutch operatively connected to said power source and said drive train.

16. The ice breaking apparatus as claimed in claim 1 further comprising a transmission operatively connected to said power source and said drive train.

17. The ice breaking apparatus as claimed in claim 1 further comprising a pair of counter-rotatable brushes adapted to sweep debris.

18. A power driven ice breaking apparatus comprising:

a housing having a top, a bottom, a first lateral side and a second lateral side;

a power source carried by said housing;

a drive train operatively connected to said power source, said drive train including a drive shaft having an axis of rotation, a first end, and a second end;

at least one laterally extended blade adapted to reciprocate substantially vertically disposed on said bottom side of said housing;

at least one crank connected to said drive shaft and pivotally connected to said at least one blade;

whereby a rotational motion of said drive shaft and said at least one crank about said axis of rotation imparts a substantially vertical reciprocating motion to said at least one laterally extended blade.

19. The ice breaking apparatus as claimed in claim 18 further comprising an adjustor that adjusts an extent of the substantially vertical reciprocating motion of one end of said at least one laterally extended blade.

20. The ice breaking apparatus as claimed in claim 18 wherein said at least one laterally extended blade comprises two blades.

21. The ice breaking apparatus as claimed in claim 20 further comprising a sharp chopping blade and a blunt crushing blade.

22. A power driven ice breaking apparatus comprising:

a housing having a top, a bottom, a first lateral side and a second lateral side;

a power source connected to said housing;

a drive train operatively connected to said power source, said drive train including a drive shaft, said drive shaft having a first end and a second end;

at least one blade having a first end and a second end disposed on said bottom side of said housing, said at least one blade extends laterally from said first lateral side of said housing to said second lateral side of said housing;

at least one connecting rod having a leading end and a following end, said following end connected to said at least one blade;

at least one crank connected to said drive shaft, said at least one crank being pivotally connected to said leading end of said at least one connecting rod;

a first guide channel connected to the bottom of said housing proximate to the first lateral side thereof, said first end of said at least one blade being slidingly engaged in said first guide channel;

a second guide channel connected to the bottom of said housing proximate to the second lateral side thereof, said second end of said at least one blade being slidingly engaged in said second guide channel;

wherein said at least one blade further comprises a sharp chopping blade and a blunt crushing blade.

23. The ice breaking apparatus as claimed in claim 22 further comprising an adjustor that adjusts an extent of motion of one end of at least one of said sharp chopping blade and said blunt crushing blade.

* * * * *